US006057280A

United States Patent [19]

Huish et al.

[11] Patent Number: 6,057,280

[45] Date of Patent: May 2, 2000

[54] COMPOSITIONS CONTAINING α-SULFOFATTY ACID ESTERS AND METHODS OF MAKING AND USING THE SAME

[75] Inventors: Paul Danton Huish, S.L.C.; Laurie A. Jensen, Midvale; Pule B. Libe, Salt Lake City, all of Utah

[73] Assignee: Huish Detergents, Inc., Salt Lake City, Utah

[21] Appl. No.: 09/195,785

[22] Filed: Nov. 19, 1998

[51] Int. Cl.[7] ..... C11D 17/00

[52] U.S. Cl. ..... 510/440; 446/450; 446/447

[58] Field of Search ..... 510/351, 352, 510/357, 298, 383, 426, 427, 428, 425, 422, 424, 440; 560/147

[56] References Cited

U.S. PATENT DOCUMENTS

Re. 32,763 10/1988 Fernholtz et al. .
Re. 32,818 1/1989 Fernholtz et al. .

(List continued on next page.)

FOREIGN PATENT DOCUMENTS 1014058 4/1963 United Kingdom .

OTHER PUBLICATIONS

The Merck Index, an Encyclopedia of Chemicals, and Biologicals, Twelfth Editions, 1996—p. 7741.

4th World Surfactants Congress, vol. 2, Aepsat Cesio, 1996, Physico–chemical properties of some salts of sulfo methyl ester surfactants, pp. 382–391. nma.

Relationship of Structure to Properties of Surfactants. 16 Linear Decylidphenylether Sulfonates. Journal of American Oil Chemists' Society, vol. 69, No. 1, Jan. 1992, Milton J. Rosen, Zhen Huo Zhu and Xi Yuan Hua, pp. 30–33. nma.

Hawley's Condensed Chemical Dictionary, Twelfth Edition, 1993 Revised by Richard J. Lewis, Sr. Published by Van Nostrand Reinhold Company. pp. 488–489; 508–509; 938–941. nma.

Kirk–Othmer Encyclopedia of Chemical Technology, Fourth Edition, vol. 23, Surfactants, pp. 476–541. nma.

Predicting Surfactant Solution Behavior. Chemithon Corporation, Enabling Science, Mar. 1996. Nancy J. Zoelier, Anat Shiloach and Daniel Blankschtein. pp. 24–31.

Surfactants. International News on Fats, Oils and Related Materials, vol. 7, Jan. 1996. pp. 10–12.

Kirk–Othmer Encyclopedia of Chemical Technology, Fourth Edition, vol. 7, Detergency pp. 1072–1117. nma.

Liquid Detergents From Cationic, Anionic and Nonionic Surfactants, Adsorption, Detergency and Antistatic Properties. Journal of American Oil Chemists' Society, vol. 66, No. 9, Sep. 1989. K. Martin E. Hellsten, Anders Klingberg and B.T. Gunvor Karlsson, pp. 1381–1385.

A. Kirk–Othmer Encyclopedia of Chemical Technology, Fourth Edition, vol. 23, Sulfonation and Sulfation pp. 146–193. nma.

Anionic Surfactants. Organic Chemistry Surfactant Science Series, vol. 56, 1996. H.W. Stache, editor., Modern SO3 Sulfonation Technology, pp. 646–697. Nma.

Sulphonation Technology for Surfactant Specialties. Proceedings of the Second World Conference Looking Towards the 90's. American Oil Chemists' Society, Montreux, Switzerland, Oct. 5–10, 1986. A.R. Baldwin, editor, SO3 Sulfonation Technology for Surfactant Specialties, pp. 234–241.

Anionic Surfactants. Organic Chemistry Surfactant Science Series, vol. 56, 1996. H.W. Stache, editor, α–Sulfomonocarboxylic Esters, pp. 461–499. nma.

Applications of MES in Detergents. International News on Fats, Oils and Related Materials, vol. 3, No. 10, Oct. 1992. pp. 1099–1108.

Anionic Surfactants, Part II. Surfactant Science Series, vol. 7, 1976. W.M. Linfield, editor, alpha–Sulfomonocarboxylic Acids and Derivatives, pp. 380–405. nma.

Anionic Surfactants, Part I. Surfactant Science Series, vol. 7, 1976. W.M. Linfield, editor, Lipid and other nonpetrochemical raw materials, pp. 86–135. nma.

Life Cycle Assessment of Palm Alcohol Sulfate. International News on Fats, Oils and Related Materials, vol. 6, No. 6, Jun. 1995, H.J. Kluppet, F. Hirsinger, J. Knaut and K.P. Schick. pp. 647–657.

Anionic Surfactants. Organic Chemistry Surfactant Science Series, vol. 56, 1996. H.W. Stache, editor, Raw materials and intermediate products for anionic surfactant synthesis, pp. 1–39. nma.

Enviromental Regulatory Agenda Shifting. International News on Fats, Oils and Related Materials, vol. 6, No. 6, Jun. 1995, pp. 632–646.

Fate of Secondary Alkane Sulfonate Surfactants During Municipal Wastewater Treatment. Wat. Res. vol. 29, No. 5, 1995. Elsevier Science Ltd., Jennifer A. Field, Thomas M. Field, Thomas Poiger, Hansruedi Siegrist and Walter Giger. pp. 1301–1307.

Oleochemicals–Outlook to the 90's. Proceedings of the Second World Conference Looking Towards the 90's. American Oil Chemists' Society, Montreux, Switzerland, Oct. 5–10, 1986, A.R. Baldwin, editor, pp. 45–59. nma.

Changes in Washing Machines Can Affect Formulations. International News on Fats, Oils and Related Materials, vol. 7, No. 1, Jan. 1996, pp. 26–29.

(List continued on next page.)

*Primary Examiner*—Necholus Ogden
*Attorney, Agent, or Firm*—Parsons, Behle & Latimer

[57] ABSTRACT

The invention includes compositions containing one or more α-sulfofatty acid esters, and methods for making and using the same. At least one α-sulfofatty acid ester is included in an inner portion. The invented composition can further include an outer portion which protects the α-sulfofatty acid ester from di-salt formation. The resulting composition improves the stability of the α-sulfofatty acid ester after manufacture, during shipping and storage, and in detergents. The invention further included detergents containing the invented composition, and methods of making such detergents.

25 Claims, No Drawings

U.S. PATENT DOCUMENTS 3,954,643 5/1976 Krings et al. .
3,962,107 6/1976 Levin et al. .
4,064,062 12/1977 Yurko .
4,194,986 3/1980 Tournier et al. .
4,219,435 8/1980 Biard et al. .
4,438,025 3/1984 Satsuki et al. .
4,487,710 12/1984 Kaminsky .
4,495,092 1/1985 Schmid et al. .
4,518,516 5/1985 Godard et al. .
4,529,587 7/1985 Green .
4,549,984 10/1985 Satsuki et al. .
4,569,780 2/1986 Fernholz et al. .
4,587,031 5/1986 Kruse et al. .
4,588,080 5/1986 Ginn .
4,589,994 5/1986 Moseman .
4,642,197 2/1987 Kruse et al. .
4,671,895 6/1987 Erilli et al. .
4,671,900 6/1987 Schmid et al. .
4,680,143 7/1987 Edge et al. .
4,692,271 9/1987 Messenger et al. .
4,726,908 2/1988 Kruse et al. .
4,735,735 4/1988 Borggrefe et al. .
4,754,075 6/1988 Knopf et al. .
4,772,425 9/1988 Chirash et al. .
4,775,653 10/1988 Leach et al. .
4,797,231 1/1989 Schumann et al. .
4,816,188 3/1989 Kitano et al. .
4,820,673 4/1989 Knopf et al. .
4,828,745 5/1989 Jeschke et al. .
4,828,749 5/1989 Kruse et al. .
4,830,773 5/1989 Olson .
4,835,321 5/1989 Leach et al. .
4,839,078 6/1989 Kruse et al. .
4,913,832 4/1990 Kruse et al. .
4,915,864 4/1990 Kita et al. .
4,919,839 4/1990 Durbutr et al. .
4,931,202 6/1990 Cotter et al. .
5,026,400 6/1991 Holland et al. .
5,066,425 11/1991 Ofosu-Asante et al. .
5,078,916 1/1992 Kok et al. .
5,108,660 4/1992 Michael .
5,118,440 6/1992 Cutler et al. .
5,130,056 7/1992 Jakobson et al. .
5,133,892 7/1992 Chun et al. .
5,191,104 3/1993 King .
5,213,705 5/1993 Olson .
5,220,046 6/1993 Leach et al. .
5,225,100 7/1993 Fry et al. .
5,262,079 11/1993 Kacher et al. .
5,269,974 12/1993 Ofosu-Asante .
5,324,649 6/1994 Arnold et al. .
5,329,030 7/1994 Schenker et al. .
5,340,492 8/1994 Kacher et al. .
5,354,493 10/1994 Wilms .
5,356,968 10/1994 Rupaner et al. .
5,358,655 10/1994 Kruse et al. .
5,374,750 12/1994 Nakamura et al. .
5,376,310 12/1994 Cripe et al. .
5,378,409 1/1995 Ofosu-Asante .
5,382,677 1/1995 Colignon et al. .
5,384,422 1/1995 Colignon et al. .
5,386,045 1/1995 Weerasooriya et al. .
5,391,783 2/1995 Colignon et al. .
5,393,468 2/1995 Erilli et al. .
5,397,494 3/1995 Vega et al. .
5,409,640 4/1995 Giret et al. .
5,415,801 5/1995 Ofosu-Asante .
5,415,814 5/1995 Ofosu-Asante et al. .
5,417,893 5/1995 Ofosu-Asante .
5,429,773 7/1995 Sherry et al. .
5,441,667 8/1995 Tonomura et al. .
5,454,981 10/1995 Sherry et al. .
5,475,134 12/1995 Baker .
5,482,641 1/1996 Fleisher .
5,527,489 6/1996 Tadsen et al. .
5,534,195 7/1996 Chapman et al. .
5,534,196 7/1996 Chapman et al. .
5,534,200 7/1996 Erilli et al. .
5,545,354 8/1996 Ofosu-Asante .
5,554,315 9/1996 Tonomura et al. .
5,576,277 11/1996 MacBeath et al. .
5,580,850 12/1996 Llosas et al. .
5,591,377 1/1997 Nickel et al. .
5,607,910 3/1997 Sherry et al. .
5,610,131 3/1997 Donoghue et al. .
5,614,484 3/1997 Panandiker .
5,616,781 4/1997 Sajic et al. .
5,627,121 5/1997 Lin et al. .
5,635,467 6/1997 Staley .
5,637,560 6/1997 Rawhse et al. .
5,637,758 6/1997 Sajic et al. .
5,643,864 7/1997 Li et al. .
5,645,883 7/1997 Russell et al. .
5,646,107 7/1997 Emery et al. .
5,656,586 8/1997 Li et al. .
5,681,803 10/1997 Okano et al. .
5,688,754 11/1997 Drapier .
5,688,982 11/1997 Khan et al. .
5,691,296 11/1997 Agar et al. .
5,695,575 12/1997 Angevaare et al. .
5,698,513 12/1997 Schulz et al. .
5,705,465 1/1998 Angevaare et al. .
5,710,121 1/1998 Tracy et al. .
5,759,977 6/1998 van den Brom et al. .
5,783,540 7/1998 Secemski et al. .
5,783,541 7/1998 Tack et al. .
5,786,320 7/1998 Urfer et al. .
5,792,219 8/1998 Hartman et al. .
5,795,854 8/1998 Angell et al. .
5,795,856 8/1998 Hatano et al. .
5,804,625 9/1998 Temperante et al. .
5,814,596 9/1998 Aquad et al. .
5,817,844 10/1998 Hama et al. .
5,830,843 11/1998 Hartman et al. .
B1 4,692,271 7/1997 Messenger et al. .

OTHER PUBLICATIONS

Soaps and Detergents. Chemical and Engineering News, Jan. 17, 1997, pp. 30–45.

Detergents' Tumultuous. International News on Fats, Oils and Related Materials, vol. 7, No. 1, Jan. 1996. pp. 6–7.

Selective Synthesis of Aliphatic Ethylene Glycol Sulfonate Surfactants. Acta Chemica Scandinavica, 1996. Odd R. Gautun. Per H.J. Carlsen, Trygve Maldal, Olav Vikane and Eimund Gilje, pp. 170–177. nma.

Hydroxy Alkane Sylfonate (HAS), a New Surfactant Based on Olefins. Journal of American Oil Chemists' Society, vol. 69, No. 1, Jan. 1992, J.Stapersman, H.H. Deuling and R. van Ginkel, pp. 39–43.

COMPOSITIONS CONTAINING α-SULFOFATTY ACID ESTERS AND METHODS OF MAKING AND USING THE SAME

BACKGROUND OF THE INVENTION

The present invention generally relates to detergent compositions and additives used in those compositions. Specifically, the present invention relates to compositions containing α-sulfofatty acid esters that can be additives to a detergent, and methods for making and using the same.

Detergent compositions have been known and used as cleaning agents for many years. See U.S. Pat. Nos. 5,783,540, 5,133,892, 4,219,435, 5,358,655, 4,913,832, 5,324,649, 5,397,494, 4,828,745, 4,588,080, 4,518,516, 5,482,641, 4,569,780, 4,828,749, Re. 32,763, and Re. 32,818, the disclosures of which are incorporated herein by reference. A large number of surfactants have been used with detergents because of their excellent surface-activity characteristics. Recently, interest in α-sulfofatty acid esters (also referred to hereafter as "sulfofatty acids") has increased due to the superior cleaning properties of these compounds. For example, see U.S. Pat. Nos. 5,681,803, 4,816,188, 5,688,982, 5,475,134, and 5,429,773, the disclosures of which are incorporated herein by reference.

α-Sulfofatty acid esters are typically manufactured as sulfofatty acid salts. These salts also exhibit surface active agent properties. Sulfofatty acid salts can be a mixture of salt forms, typically including mono- and di-salts. For example, methyl ester sulfonate ("MES") has both mono- and di-salt forms, i.e. mono-sodium MES ("msMES") and di-sodium MES ("dsMES"). Mono-salts of sulfofatty acids generally have superior washing properties as compared with the di-salt forms. The mono-salts are unstable, however, and react with alkali-containing detergent components to form di-salts. In particular, di-salts form under alkaline conditions at pH values of 9 or greater. For example, mono-sodium methyl ester sulfonate reacts with caustic soda (NaOH) to form a di-salt by the following chemical reaction:

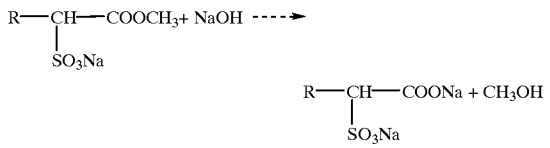

Other bases also catalyze di-salt formation. Moisture and/or humid conditions can accelerate base-catalyzed di-salt formation. Heat, in the presence of moisture or humid conditions, can further accelerate di-salt formation.

The formation of di-salts detracts from the desirability of sulfofatty acids as a detergent additive. As the amount of di-salt increases, the amount of the mono-salt correspondingly decreases. To compensate, more mono-salt of the sulfofatty acid must be added to a detergent mixture to provide the same level of surface active agent performance, which increases the cost and unit size of the detergent. Thus, there is a need for compositions, and methods of making and using such compositions, which limit additional di-salt formation in sulfofatty acids.

OBJECTS AND SUMMARY OF THE INVENTION

It is an object of the present invention to provide a composition that protects α-sulfofatty acid esters from di-salt formation.

It is a further object of the invention to provide a composition, such as a detergent additive, having an inner portion containing at least one α-sulfofatty acid ester and an outer portion that protects the α-sulfofatty acid ester from di-salt formation.

It is another object of the invention to provide a detergent containing such a composition. It is still another object of the invention to provide a method of making such a composition, as well as a method of making a detergent containing such a composition.

The present invention includes compositions having an inner portion containing α-sulfofatty acid ester and an outer portion on any part of the inner portion. Preferably, the outer portion is disposed on any outer surface of the inner portion. More preferably, the outer portion is a coating. The outer portion inhibits di-salt formation by protecting the sulfofatty acid from base-catalyzed di-salt formation, and from substances or conditions, such as moisture alone or in combination with an elevated temperature, which accelerate or increase di-salt formation. Such protection can occur by physically or chemically blocking the sulfofatty acid from exposure to substances of conditions which cause di-salt formation, or by neutralizing di-salt forming substances before they interact with sulfofatty acid. By providing such protection, the invented sulfofatty acid composition beneficially extends the useful life of α-sulfofatty acid ester after its manufacture, during shipping and storage, and/or as a detergent ingredient.

In another embodiment of the present invention, the inner portion contains one or more other detergent components. Suitable detergent components are those that do not promote more than a minor amount of di-salt formation when in the presence of sulfofatty acid. For example, detergent components such as other surfactants or non-basic salt may be mixed with sulfofatty acid to form the inner portion.

In any of the embodiments of the present invention, the sulfofatty acid may be a methyl ester sulfonate, and more preferably a sodium methyl ester sulfonate. The shape of the composition—such as a tablet, cylinder or sphere—may be chosen according to the method of making, or intended use of, the composition, as will be appreciated by those skilled in the art.

The present invention further includes methods of making compositions containing at least one α-sulfofatty acid ester. Such methods generally include providing an inner portion containing at least one α-sulfofatty acid ester and providing an outer portion on any part of the inner portion. Preferably, the outer portion is disposed on any outer surface of the inner portion. More preferably, the method includes forming an inner portion containing at least one α-sulfofatty acid ester and applying an outer portion on outer surface of the inner portion. In any of these methods, the outer portion protects or inhibits the at least one α-sulfofatty acid ester from di-salt formation.

The outer portion preferably covers the inner portion. It is not required, however, that the outer portion cover the entire surface of the inner portion. The outer portion can be formed on any part of the inner portion. Preferably, the outer portion can be formed on any part of the outer surface of the inner portion. Techniques for applying the outer portion to the inner portion include, but are not limited to, spray coating, dip coating, spin coating, and spray-drying. Suitable methods of spray drying include counter-current and co-current methods. Another technique for applying the outer portion is agglomeration, in which the inner portion is mixed with an outer portion material to form the invented composition.

The present invention also includes methods for manufacturing detergents, or parts of detergent formulations, using a composition containing at least one α-sulfofatty acid ester. One method includes providing a composition having an inner portion containing at least one α-sulfofatty acid ester and mixing the composition with at least one detergent component. A more preferred method includes providing a composition having an inner portion containing at least one α-sulfofatty acid ester and an outer portion, and mixing the composition with other detergent components to form a detergent or a part of a detergent formulation. Methods of mixing the invented composition with detergent components can include dry-blending, post-adding, agglomerating or spray drying the sulfofatty acid composition with such other detergent components. For example, a detergent can be made by providing a suitable amount of the invented composition containing at least one α-sulfofatty acid ester and mixing it with other detergents components, including soaps, other surfactants, and/or alkaline material(s), by dry-blending. Dry blending or post-adding are the preferred methods of mixing.

DETAILED DESCRIPTION OF THE INVENTION

The following description provides specific details, such as materials and dimensions, to provide a thorough understanding of the present invention. The skilled artisan, however, will appreciate that the present invention may be practiced without employing these specific details. Indeed, the present invention can be practiced in conjunction with processing, manufacturing or fabricating techniques conventionally used in the detergent industry. Moreover, the processes below describe only steps, rather than a complete process flow, for manufacturing the invented composition, and detergents containing the invented composition.

One composition of the present invention contains at least two portions. An inner portion contains at least one α-sulfofatty acid ester. An outer portion is disposed on any part of the inner portion. Generally, the sulfofatty acid composition is made by providing an inner portion, and then providing the outer portion.

Methods of manufacturing α-sulfofatty acid esters are well known to those skilled in the art. For example, see U.S. Pat. Nos. 5,329,030, 5,382,677, 5,384,422, 4,816,188, and 4,671,900, the disclosures of which are incorporated herein by reference. Sulfofatty acid can be manufactured from a variety of sources, including beef tallow, palm kernel oil, palm stearin oil, coconut oil, soybean oil, canola oil, cohune oil, palm oil, white grease, cottonseed oil, and mixtures thereof and fractions thereof. Sulfofatty acid made from one or more of these sources is within the scope of the present invention.

The α-sulfofatty acid ester of the present invention is generally of the following formula

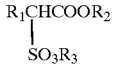

(I)

wherein $R_1$ and $R_2$ are alkyl groups and $R_3$ is an alkyl group, hydrogen, halogen or metal. Any alkyl group can be used in the sulfofatty acid as $R_1$, $R_2$ or $R_3$, depending on the preferred detergent characteristics of the final product. Preferably, $R_1$ is an alkyl group containing 8 to 22 carbon atoms, and more preferably a $C_{16}$ or $C_{18}$ alkane. $R_2$ is preferably an alkyl group containing 1 to 8 carbon atoms, and more preferably a methyl group, $R_3$ is preferably a metal.

More preferably, the α-sulfofatty acid ester is a salt. Such salts are generally of the following formula II:

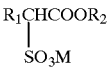

(II)

wherein $R_1$ and $R_2$ are alkanes and M is a monovalent metal. Preferably, $R_1$ is an alkane containing 8 to 22 carbon atoms, and more preferably a $C_{16}$ or $C_{18}$ alkane. $R_2$ is preferably an alkyl group containing 1 to 8 carbon atoms, and more preferably a methyl group. M is preferably an alkali metal, and most preferably sodium. Most preferably, sodium methyl ester sulfonate ("sMES") is employed as the sulfofatty acid in the present invention.

The invented composition can include more than one type of sulfofatty acid within the inner portion. As will be appreciated by those skilled in the art, the proportions of different types of sulfofatty acids can be varied according to the properties of the sulfofatty acids. For example, $C_{16}$ and $C_{18}$ sulfofatty acids (e.g. beef tallow MES) are generally solid at room temperature provide better surface active agent properties, but are less soluble in concentrated solutions. $C_{12}$ and $C_{14}$ sulfofatty acids (e.g. palm kernel or palm oil MES) are more fluid at room temperature are more soluble in water, but have lower surface active agent properties. Thus, one preferred embodiment includes about 1 to about 100 weight percent $C_{16}$ or $C_{18}$ α-sulfofatty acid ester. Another preferred embodiment will include a mixture of about 1 to about 99 weight percent of $C_{16}$ sulfofatty acid and about 99 to about 1 weight percent of $C_{18}$ sulfofatty acid.

In another preferred embodiment, a $C_{12}$ and/or $C_{14}$ sulfofatty acid is combined with a $C_{16}$ and/or $C_{18}$ sulfofatty acid to provide a better substrate for receiving the outer portion. For example, about 10–20 weight percent $C_{12}$ and/or $C_{14}$ sulfofatty acid can be combined with about 80–90 weight percent $C_{16}$ and/or $C_{18}$ sulfofatty acid to provide a firmer substrate for receiving the outer portion. Other mixtures of $C_{12}$ and/or $C_{14}$ with $C_{16}$ and/or $C_{18}$ sulfofatty acids are also within the scope of the present invention, as will be appreciated by those skilled in the art.

The total amount of sulfofatty acid in the inner portion of the invented composition can also vary, depending on the specific embodiment of the invention. For example, for sulfofatty acid which is coated at the end of the manufacturing process, the inner portion may be about 50 to 100 weight percent sulfofatty acid, with the balance being by-products of the manufacturing process. The sulfofatty acid may include some di-salt which is formed during the manufacturing process.

The outer portion of the invented composition is disposed on any part of the inner portion. The outer portion may be composed of any suitable material that provides the desired protection to the sulfofatty acid in the inner portion. Suitable materials for the outer portion include vinyl polymers, such as polyvinyl alcohol, partially or fully hydrolyzed polyvinyl alcohol, polyvinyl acetate, polyvinyl pyrrolidone, or polyvinyl-methylmethacrylate copolymer, maleic acid/acrylic acid copolymers or salts thereof, ethylene/maleic anhydride copolymers, polyethylene glycol, acrylic acid polymer, carboxymethyl cellulose, cellulose ether, paraffin waxes, fatty acids, methyl ester sulfonate, soaps, waxes, other water-soluble polymers, other water-swellable polymers, and copolymers or mixtures thereof.

The outer portion preferably prevents more than a minor amount of additional di-salt formation by the α-sulfofatty acid ester. As used hereafter, the term a "minor amount" means that no more than about 30 weight percent di-salt. Preferably, a minor amount is no more than about 15 weight percent di-salt. More preferably, a minor amount is no more than about 7 weight percent di-salt. As will be appreciated by those skilled in the art, the preceding ranges apply to additional di-salt formation and exclude di-salt already present in the sulfofatty acid as a result of the manufacturing process. The method of George Battaglini et al., *Analytical Methods for Alpha Sulfo Methyl Tallowate,* JOACS, Vol. 63, No. 8 (August, 1986), can be used to determine the amount of di-salt in an α-sulfofatty acid ester sample, and any increase in such a sample having an outer portion as compared with a control sample. The disclosure of this reference is incorporated by reference herein.

The outer portion is preferably chemically-compatible with the α-sulfofatty acid ester(s). A chemically-compatible outer portion is one promoting less than a minor amount of additional di-salt formation when contacting the sulfofatty acid.

In one preferred embodiment of the invention, the outer portion prevents the penetration of bases, moisture, and other di-salt promoting substances into the inner portion. Such an outer portion is preferably water-resistant. In such an embodiment, the outer portion preferably has a melting point within normal washing temperatures. In a more preferred embodiment, the melting point of the outer portion is within the range of about 100° to about 160° F.

In another preferred embodiment, the outer portion is water-soluble. Such a water-soluble outer portion can be an inert or non-reactive ingredient (hereafter "inert") or another detergent component, such a builder or another surfactant. The water-soluble outer portion may also include another layer of α-sulfofatty acid ester, such as sMES. For a water-soluble outer portion, it is not necessary that the outer portion have a melting point within the range of normal washing temperatures.

The outer portion can be applied on any part of the inner portion according to techniques conventionally used in the detergent industry. Other techniques for applying outer portions, such as those used in the pharmaceutical industry, are also within the scope of the present invention, as will be appreciated by those skilled in the art. Examples of suitable techniques for applying an outer portion include dip coating, spin coating, and spray coating. Other suitable methods will include spray drying, including spray drying using counter-current or co-current techniques. Another method for applying the outer portion is agglomeration, such as by mixing the inner portion with an outer portion material. It is also contemplated that the outer portion can also be applied using a fluid bed dryer. Suitable fluid bed dryers could include static, vibrating, high-shear granulating, vacuum fluid bed, tablet pan coating, rotor processing, and wurster high speed fluid bed dryers. Following formation of a composition containing an inner portion and an outer portion, the outer portion can be dried, as necessary, to remove excess moisture or other liquid.

A preferred method of providing the outer portion may further include the use of a carrier or solvent to aid in applying the outer portion material to the inner portion. For example, for a water-soluble outer portion materials (e.g. polyvinyl alcohol), the outer portion material may be mixed with water and then applied to the inner portion. Similarly, other carriers or solvents can be used to apply the outer portion material, according to the solubility of the desired outer portion material. One or more thinning agents, that facilitate application of the outer portion material, can be used. Where a solvent, carrier or thinner is used, the outer portion can be dried, as necessary, to remove excess moisture.

A carrier, solvent or thinner is preferably chemically-compatible with sulfofatty acid, such that the carrier, solvent or thinner does not promote more than a minor amount of di-salt formation when in contact with the sulfofatty acid. Chemical compatibility can be determined by exposing a sulfofatty acid sample to the chemical and then measuring the amount of di-salt due to such exposure, such as the method disclosed by Battaglini et al.

In another preferred embodiment of the present invention, the inner portion includes inert ingredients or other detergent components. Inert ingredients include process-control agents and density-control agents, as will be appreciated by those skilled in the art. Inert ingredients are those which promote less than about 7% additional di-salt formation. Preferably, the inert ingredients promote less than about 1% additional di-salt formation.

Suitable inert ingredients will include salts, such as sodium chloride and sodium sulfate. These salts can be combined with one or more sulfofatty acids to provide a less concentrated inner portion containing at least one α-sulfofatty acid ester. Similarly, the inert ingredients can be combined with $C_{12}$ and/or $C_{14}$ α-sulfofatty acid ester to provide a better substrate for receiving the outer portion. In particular, combining $C_{12}$ and/or $C_{14}$ α-sulfofatty acid ester with inert ingredients, such as about 1 to about 35 weight percent sodium chloride or sodium sulfate, can provide a firmer substrate for receiving the outer portion.

Other detergent components can also be included in the inner portion, provided that such components do not promote more than a minor amount of di-salt formation when the component is in contact with sulfofatty acid. Suitable detergent components include, but are not limited to, non-basic salts, anionic surfactants, nonionic surfactants, cationic surfactants, zwitterionic surfactants, polymers, foam regulators, binders, fillers, and mixtures of any of these. For example, an α-sulfofatty acid ester can be combined with another surfactant prior to applying the outer portion.

For any of these embodiments, the relative amounts of the inner portion and the outer portion depend on the intended use of the invented composition and the desired level of protection. For example, if the outer portion is an inert ingredient, the ratio of the outer portion to the inner portion may be minimized. If the invented composition will be exposed to large amounts of alkaline agents, moisture, or moisture and heat, a thicker outer portion can be applied to provide additional protection. In another embodiment, if the outer portion includes one or more other detergent components, the ratio of the amount of outer portion to the inner portion may be selected to optimize the relative proportions of these components and the α-sulfofatty acid ester.

In another embodiment of the present invention, the composition can further include a middle portion disposed between the inner and outer portions. Such a middle portion can contain one or more outer portion materials, at least one inert ingredient, and/or at least one other detergent component, as will be appreciated by those skilled in the art.

The present invention prevents additional di-salt formation in sulfofatty acid. While mono-salts of sulfofatty acid have preferred properties as surface active agents, particularly in hard water, di-salts have properties more similar to soap. In some embodiments of the present invention, it may be desirable to add one or more di-salts of sulfofatty acid to the inner and/or outer portion of the invented composition.

The present invention can be made in conjunction with processing, manufacturing or fabricating techniques conventionally used in the detergent industry. One preferred method of making the invented composition includes the steps of providing an inner portion containing at least one α-sulfofatty acid ester and providing an outer portion on any part of the inner portion. The outer portion protects the at least one α-sulfofatty acid ester from di-salt formation. In a preferred embodiment of the invention, the method includes forming an inner portion containing at least one α-sulfofatty acid ester, and then forming an outer portion on the inner portion.

The shape of the inner portion can be modified prior to providing the outer portion. For example, for sulfofatty acid which is extruded on a cooled belt, the sulfofatty acid may be ground to a powder prior to applying the outer portion. Alternatively, the sulfofatty acid may be shaped into pellets, tablets or other shapes prior to applying the outer portion. In a preferred embodiment of the invention, the size of the invented composition is about 100 to about 2000 μm, although smaller or larger particles are within the scope of the invention.

The present invention further includes a method of using the invented sulfofatty acid composition as an ingredient in detergents. One preferred method includes providing at least one composition having an inner portion containing at least one α-sulfofatty acid ester, and mixing the composition with at least one other detergent component to form a detergent or part of a detergent formulation (hereafter referred to generically as a detergent, unless otherwise specified). Another preferred method includes providing at least one composition having an inner portion containing at least one α-sulfofatty acid ester and an outer portion and mixing the composition with other detergent components to form a detergent.

Suitable detergent components include, but are not limited to, one or more chlorine-containing agents, alkali salts, basic substances, non-alkaline salts, anionic surfactants, nonionic surfactants, cationic surfactants, zwitterionic surfactants, sodium borate, persalts such as sodium perborate or sodium percarbonate, zeolite such as zeolite A, polymer, fragrance, foam regulators, binders, dyes, water, fillers, optical brighteners, and mixtures of any of these. The resulting detergent can include a powder, pellets or tablets or other suitable shapes.

Other embodiments of the present invention are exemplified in the following working examples. These examples illustrate working principles of the present invention, although the present invention is not intended to be limited by or to these examples.

EXAMPLES

In these examples, the percentages are given as weight percents, unless otherwise indicated. The ratio of di-salt to mono-salt is calculated as follows:

$$\frac{\text{amount of di-salt formed} - \text{original di-salt content}}{\text{total amount of active (mono-salt and di-salt)}}$$

This ratio is also referred to as the "% di-salt/active."

EXAMPLE 1

A sample of sodium methyl ester sulfonate, containing about 81% total active material (about 78 weight percent msMES and about 3 weight percent dsMES) was formed into several inner portions and mixed with varying amounts of other detergent components into a standard detergent formulation. The detergent formulation included alkaline agents. The formulations were incubated in an oven at elevated temperature (105° F.) and elevated humidity (80% relative humidity). Table 1 shows the resulting amount of additional di-salt formation due to the interaction of the alkaline agents with the sodium methyl ester sulfonate in the inner portion.

TABLE 1

| Percentage sMES in Detergent | Time | % Di-salt/Active - without outer portion |
|---|---|---|
| 9% sMES | 192 days | 60.3% |
| 40% sMES | 215 days | 78.1% |

Thus, in the absence of an outer portion, significant di-salt formation occurred.

EXAMPLE 2

A 40% sMES detergent formulation, containing an inner portion of sodium methyl ester sulfonate, was held at room temperature and low relative humidity (20%) for up to 255 days. The formulation has about 4.5% di-salt/active, thus demonstrating the importance of excluding moisture and heat from the α-sulfofatty acid ester. Similarly, a 20% sMES detergent formulation, containing an inner portion of sodium methyl ester sulfonate, was held at elevated temperature (105° F.) but low relative humidity (20%) for up to 154 days. This formulation had up to 8.4% di-salt/active. This example demonstrate the benefit of excluding moisture from detergent formulations containing α-sulfofatty acid ester.

EXAMPLE 3

A first sample, having an inner portion of sodium methyl ester sulfonate but no outer portion, was mixed into a standard detergent formulation and then exposed to elevated temperature (105° F.) and humidity (80% relative humidity) for 28 days. A second sample, having an inner portion of sMES and an outer portion applied by agglomerating the inner portion with polyvinyl alcohol and water in a KITCHENAID™ mixer, was mixed with a similar standard detergent formulation. Referring to Table 2, the weight percent increase in di-salt in these samples was as follows:

TABLE 2

| Time | % Di-salt/Active - without outer portion | % Di-salt/Active- with outer portion |
|---|---|---|
| 0 | 0% | 0% |
| 8 days | 0.7% | 0% |
| 21 days | 30.3% | 6.2% |
| 28 days | 42.8% | 6.2% |

Thus, the outer portion provides significant protection from di-salt formation.

EXAMPLE 4

In a theoretical composition, sodium methyl ester sulfonate is manufactured from beef tallow methyl ester in a film type reactor using gaseous sulfur trioxide. The reaction product is neutralized using sodium hydroxide. The reaction product may optionally be bleached prior to neutralization to provide a product with a lighter color. The liquefied product, sMES, is dried, extruded, cooled on a chilled belt and allowed to solidify into pieces about one half to one inch in size. The solidified sMES is then ground into a powder in the range of about 100 to 600 micrometers in size. The powder is spray-coated with a water-soluble outer portion material, polyvinyl alcohol, followed by drying to allow the water to evaporate.

EXAMPLE 5

In another theoretical composition, an α-sulfofatty acid ester is manufactured from palm stearin methyl ester in a film type reactor using gaseous sulfur trioxide. The resulting liquefied sulfofatty acid is mixed with sodium sulfate. The mixture is allowed to cool and shaped to form tablets. An outer portion of polyvinyl alcohol is applied by spray coating.

EXAMPLE 6

In another theoretical composition, α-sulfofatty acid esters are manufactured from palm kernel oil and from beef tallow. The sulfofatty acids are combined in a ratio of 1 part palm kernel oil sulfofatty acid and 4 parts beef tallow sulfofatty acid. The mixture of sulfofatty acids is then ground or shaped, as needed, to form a powder between 200 and 800 micrometers in size and then an outer portion of sodium methyl ester sulfonate and sodium sulfate is applied to the particles in a fluid bed dryer.

EXAMPLE 7

In another theoretical example, a composition, as prepared in any of examples 4–6, is dry-blended with other detergent components.

Having thus described in detail the preferred embodiments of the present invention, it is to be understood that the invention defined by the appended claims is not to be limited by particular details set forth in the above description, as many apparent variations thereof are possible without departing from the spirit or scope thereof.

We claim:

1. A composition, comprising:

an inner portion containing at least one α-sulfofatty acid ester, the inner portion being free of substances which cause additional di-salt formation when in contact with the α-sulfofatty acid ester, said substances selected from the group consisting of zeolites, sodium silicate, sodium carbonate, caustic soda and persalts; and an outer portion protecting the inner portion from said substances or at least one condition selected from temperature and humidity which causes more than a minor amount of additional di-salt formation, said outer portion selected from polyvinyl alcohol, partially or fully hydrolyzed polyvinyl alcohol, polyvinyl acetate, polyvinyl pyrrolidone, polyvinyl-methylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers, or copolymers, salts or mixtures thereof.

2. The composition of claim 1, wherein the at least one α-sulfofatty acid ester is sodium methyl ester sulfonate.

3. The composition of claim 1, wherein the inner portion has different α-sulfofatty acid esters.

4. The composition of claim 1, wherein the outer portion forms a layer on the inner portion.

5. The composition of claim 1, wherein the outer portion is water-resistant.

6. The composition of claim 1, wherein the outer portion is water-soluble.

7. The composition of claim 1, wherein the outer portion is inert.

8. The composition of claim 1, wherein the inner portion includes at one α-sulfofatty acid ester mixed with at least one inert ingredient.

9. The composition of claim 1, wherein the inner portion includes at least one α-sulfofatty acid ester mixed with another detergent component.

10. The composition of claim 1, wherein the inner portion consists essentially of at least one α-sulfofatty acid ester.

11. The composition of claim 1, wherein the composition is a tablet or a powder.

12. A composition comprising:

an inner portion containing at least one α-sulfofatty acid ester, said inner portion being free of substances selected from the group consisting of zeolites, sodium silicate, sodium carbonate, caustic soda and persalts; and an outer portion protecting the at least one α-sulfofatty acid ester from said substances and at least one condition selected from temperature and humidity which causes more than a minor amount of additional di-salt formation, said outer portion selected from polyvinyl alcohol, partially or fully hydrolyzed polyvinyl alcohol, polyvinyl acetate, polyvinyl pyrrolidone, polyvinyl-methylmethacrylate copolymer, maleic acid/acrylic acid copolymer, ethylene/maleic anhydride copolymer, polyethylene glycol, acrylic acid polymer, carboxymethylcellulose, cellulose ether, paraffin waxes, fatty acids, methyl ester sulfonate, soaps, waxes, water-soluble polymers, water-swellable polymers, or copolymers, salts or mixtures thereof.

13. The composition of claim 12, wherein the at least one α-sulfofatty acid ester is sodium methyl ester sulfonate.

14. The composition of claim 12, wherein the outer portion forms a layer on the inner portion.

15. The composition of claim 12, wherein the inner portion has different α-sulfofatty acid esters.

16. The composition of claim 12, wherein the inner portion includes at least one α-sulfofatty acid ester mixed with at least one inert ingredient.

17. The composition of claim 12, wherein the inner portion includes at least one α-sulfofatty acid ester mixed with a detergent component.

18. The composition of claim 12, wherein the composition is a tablet or a powder.

19. The composition of claim 12, wherein the inner portion further comprises detergent components.

20. A composition comprising:

an inner portion containing at least one α-sulfofatty acid esters, the inner portion containing less than a minor amount of di-salt and being free of substances selected from the group consisting of zeolites, sodium silicate, sodium carbonate, caustic soda and persalts; and an outer portion protecting the inner portion from more than a minor amount of additional di-salt formation caused by said substances or at least one condition selected from temperature and humidity, said outer portion selected from polyvinyl alcohol, partially or fully hydrolyzed polyvinyl alcohol, polyvinyl acetate, polyvinyl pyrrolidone, polyvinyl-methylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers, or copolymers, salts or mixtures thereof.

21. A detergent comprising:

at least one composition having an inner portion containing at least one α-sulfofatty acid ester being free of substances selected from the group consisting of zeolites, sodium silicate, sodium carbonate, caustic soda and persalts, and an outer portion protecting the at least one α-sulfofatty acid ester from more than a minor amount of additional di-salt formation caused by said substances or at least one condition selected from temperature and humidity, said outer portion selected from polyvinyl alcohol, partially or fully hydrolyzed polyvinyl alcohol, polyvinyl acetate, polyvinyl pyrrolidone, polyvinyl-methylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers, or copolymers, salts or mixtures thereof; and at least one other detergent component.

22. The composition of claim 21, wherein the at least one α-sulfofatty acid ester is sodium methyl ester sulfonate.

23. The composition of claim 21, wherein the inner portion has different α-sulfofatty acid esters.

24. The composition of claim 20, wherein the composition is a tablet or a powder.

25. A detergent composition, comprising:

an inner portion containing sodium methyl ester sulfonate, the inner portion being free of substances which cause additional di-salt formation when in contact with said methyl ester sulfonate, said substances selected from the group consisting of zeolites, sodium silicate, sodium carbonate, caustic soda and persalts; and an outer portion disposed on said inner portion and protecting said methyl ester sulfonate from said substances and at least one condition selected from temperature and humidity which causes more than a minor amount of additional di-salt formation, said outer portion selected from polyvinyl alcohol, partially or fully hydrolyzed polyvinyl alcohol, polyvinyl acetate, polyvinyl, pyrrolidone, polyvinyl-methylmethacrylate copolymer, maleic acid/acrylic acid copolymer, ethylene/maleic anhydride copolymer, polyethylene glycol, acrylic acid polymer, carboxymethyl cellulose, cellulose ether, paraffin waxes, fatty acids, methyl ester sulfonate, soaps, waxes, water-soluble polymers, water-swellable polymers or copolymers, salts or mixtures thereof.

* * * * *